US010274889B2

(12) United States Patent
Tanto

(10) Patent No.: US 10,274,889 B2
(45) Date of Patent: Apr. 30, 2019

(54) IMAGE HEATING APPARATUS HAVING A BLOCKING MEMBER THAT PERMITS MOUNTING OF A HEATER UNIT AND PREVENTS MOUNTING OF THE HEATER UNIT BASED ON A STATE OF A CONNECTOR

(71) Applicant: CANON KABUSHIKI KAISHA, Tokyo (JP)

(72) Inventor: Tomoaki Tanto, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/910,520

(22) Filed: Mar. 2, 2018

(65) Prior Publication Data

US 2018/0253054 A1 Sep. 6, 2018

(30) Foreign Application Priority Data

Mar. 3, 2017 (JP) ..... 2017-040283
Jan. 10, 2018 (JP) ..... 2018-001606

(51) Int. Cl.
*G03G 15/00* (2006.01)
*G03G 15/20* (2006.01)
*G03G 21/16* (2006.01)

(52) U.S. Cl.
CPC ..... *G03G 15/80* (2013.01); *G03G 15/2017* (2013.01); *G03G 21/1685* (2013.01); *G03G 15/206* (2013.01); *G03G 15/2028* (2013.01); *G03G 15/2039* (2013.01); *G03G 2215/2009* (2013.01)

(58) Field of Classification Search
CPC ..... G03G 15/80; G03G 15/2017; G03G 15/2053; G03G 2215/2003; G03G 2215/2016
See application file for complete search history.

(56) References Cited

U.S. PATENT DOCUMENTS 5,828,035 A * 10/1998 Kuroda ..... G03G 15/2064 219/216
8,781,364 B2 7/2014 Fukuda et al.
2013/0302060 A1* 11/2013 Moriya ..... G03G 21/1652 399/90
2015/0338805 A1* 11/2015 Nakayama ..... G03G 15/2053 219/216

FOREIGN PATENT DOCUMENTS

JP 2013-076868 A2 4/2013

* cited by examiner

*Primary Examiner* — Sandra Brase
(74) *Attorney, Agent, or Firm* — Venable LLP

(57) ABSTRACT

An image heating apparatus includes a first rotatable member, a second rotatable member cooperative with the first rotatable member to form a heating nip, a first supporting plate supporting the second rotatable member, a second supporting plate rotatably supporting the second rotatable member, a heater unit including the second rotatable member, a heater configured to heat the second rotatable member, a connector mounted to the heater by movement relative to the heater in a first direction, a stopper portion configured to stop the relative movement of the connector relative to the heater in the first direction, and a blocking portion fixed on the first supporting plate. The blocking portion permits mounting of the heater unit with the connector being in the first position relative to the heater. The blocking portion prevents mounting of the heater unit with the connector being in the second position.

18 Claims, 9 Drawing Sheets

IMAGE HEATING APPARATUS HAVING A BLOCKING MEMBER THAT PERMITS MOUNTING OF A HEATER UNIT AND PREVENTS MOUNTING OF THE HEATER UNIT BASED ON A STATE OF A CONNECTOR

CLAIM TO PRIORITY

This application claims the benefit of Japanese Patent Application No. 2017 040283 filed on Mar. 3, 2017, and No. 2018-001606 filed on Jan. 10, 2018, which are hereby incorporated by reference herein in their entirety.

BACKGROUND OF THE INVENTION

Field of the Invention

The present invention relates to an image heating apparatus that is suitable for a laser beam printer (LBP), a digital copying machine, a multifunction printer, etc., which uses an electrophotographic image forming method, for example.

In recent years, a film-based fixing method has come to be widely used in the field of a fixing apparatus (image heating apparatus) for thermally fixing an unfixed toner image to a sheet of a recording medium. A film-based fixing method makes it possible to form a wider nip (fixation nip) than a roller-based fixing method, without requiring a fixing apparatus to be increased in size. Thus, it can reduce a fixing apparatus (image forming apparatus) in wait-time, size, and, also, can increase a fixing apparatus (image forming apparatus) in speed.

One of the main factors that affects the life expectancy of a fixing apparatus that uses a film-based heating method is the durability of a fixation film. Thus, it is common practice to replace the film unit of a film-based fixing apparatus, which includes a fixation film, several times during the warranty period of an image forming apparatus. There has been proposed in Japanese Laid-open Patent Application No. 2013-076868, a film-based fixing apparatus, which is structured so that the film unit can be removed from the main assembly of the fixing apparatus in order to make it possible to replace only the fixation film.

It occurs sometimes, when an operator is trying to replace the fixation film of the fixing apparatus disclosed in Japanese Laid-open Patent Application No. 2013-076868, that, in order not to touch the fixation film with his or her hand, and/or not to damage the film, the operator grasps a connector, which is on the outward side of the corresponding edge of the fixation film, that is, one of the lengthwise end portions of the film unit.

Thus, it is possible for the operator to apply a force to the portion of the connector, which is for preventing the connector from becoming unplugged from the heater (having a heat generating member) in the film unit, in the direction to unplug the connector from the heater. It is also possible for the operator to pull the cable that is in connection to the connector, in the direction to unplug the connector from the film unit. Thus, it is possible for the connector to be moved out of the range in which the electrical terminals of the connector can remain in contact with the electrical terminals of the heater as a heating member. Therefore, such an error sometimes occurs that, after the replacement of components (fixation film, etc.), the electrical terminals of the connector remain unconnected from the electrical terminals of the heater. Consequently, it sometimes takes an unexpectedly long time to replace the fixation film during the maintenance of the fixing apparatus (image forming apparatus).

For example, in a case when a fixing apparatus (image forming apparatus) is structured so that the connector is not provided with a portion that latches on the flange of the fixing apparatus to prevent the connector from disengaging from the heater, it is possible for an operator to attach the film unit without noticing that the connector is about to disengage from the heater. If the film unit is attached to the main assembly of the fixing apparatus when the connector is outside of the range in which its electrical terminals can remain in contact with the electrical terminals of the heater, there sometimes occurs such an error that there is no electrical connection between the connector and the heater.

As one of the measures to deal with this disengagement of the connector, there have been realized fixing apparatuses that are provided with a component dedicated to keep the connector connected to the flange of a fixing apparatus to prevent the disengagement of the connector from the heater. This solution, however, has proven to be problematic in that providing a fixing apparatus with an additional component increases the cost of a fixing apparatus.

SUMMARY OF THE INVENTION

Thus, a primary object of the present invention is to provide an image heating apparatus that can prevent the problem that the unit having a heater is attached to the supporting plate when the connector is in the position in which its housing is in contact with the heater, but, its electrical terminals are not in contact with the electrical terminals of the heater.

According to one aspect, the present invention provides an image heating apparatus comprising a first rotatable member, a second rotatable member cooperative with the first rotatable member to form a nip configured to heat a toner image on a recording material, a first supporting plate provided with a first groove portion rotatably supporting the second rotatable member at a first end portion side with respect to a longitudinal direction of said second rotatable member, a second supporting plate provided with a second groove portion rotatably supporting the second rotatable member at a second end portion side with respect to the longitudinal direction, the second end portion side being opposite to the first end side portion, a heater unit including the second rotatable member, a heater configured to heat the second rotatable member, a connector mounted to the heater by movement relative to the heater in a first direction, a stopper portion configured to stop the relative movement of the connector relative to the heater in the first direction, the heater unit being mounted on the first supporting plate and the second supporting plate in a state that the heater unit is mounted to the heater, wherein the heater includes a heat generating element capable of generating heat by electrical power supply thereto, a first electrode portion provided on a substrate at the first end portion side and configured to supply the electrical power to the heat generating element, and a second electrode portion of a polarity different from that of the first electrode portion, wherein the connector includes a metal terminal cooperative with the first electrode portion to constitute an electrical connection point for the electrical power supply to the heat generating element, by sandwiching the substrate, wherein the stopper portion configured to stop the relative movement of a connector in the first direction at a first position, at which the electrical connection point is constituted by the metal terminal and the first electrode portion, wherein the first electrode portion extends over a predetermined distance from the electrical connection point constituted by the metal contact and the first electrode portion at the time when the connector is in the first position, in a second direction that is opposed to the first direction, and wherein the metal contact becomes out of electrical contact with the first electrode portion in a state that the metal contact sandwiches the substrate at the second position, when the connector is moved from the first position in the second direction relative to the heater in a state of the metal terminal sandwiching the substrate, and a blocking portion fixed on the first supporting plate, wherein the blocking portion permits the heater unit to be mounted to the first supporting plate and the second supporting plate in a state that said connector is in the first position relative to the heater, and wherein the blocking portion prevents the heater unit from being mounted to the first supporting plate and the second supporting plate in a state that the connector is in the second position relative to the heater.

Further features of the present invention will become apparent from the following description of exemplary embodiments with reference to the attached drawings.

Figure 2:
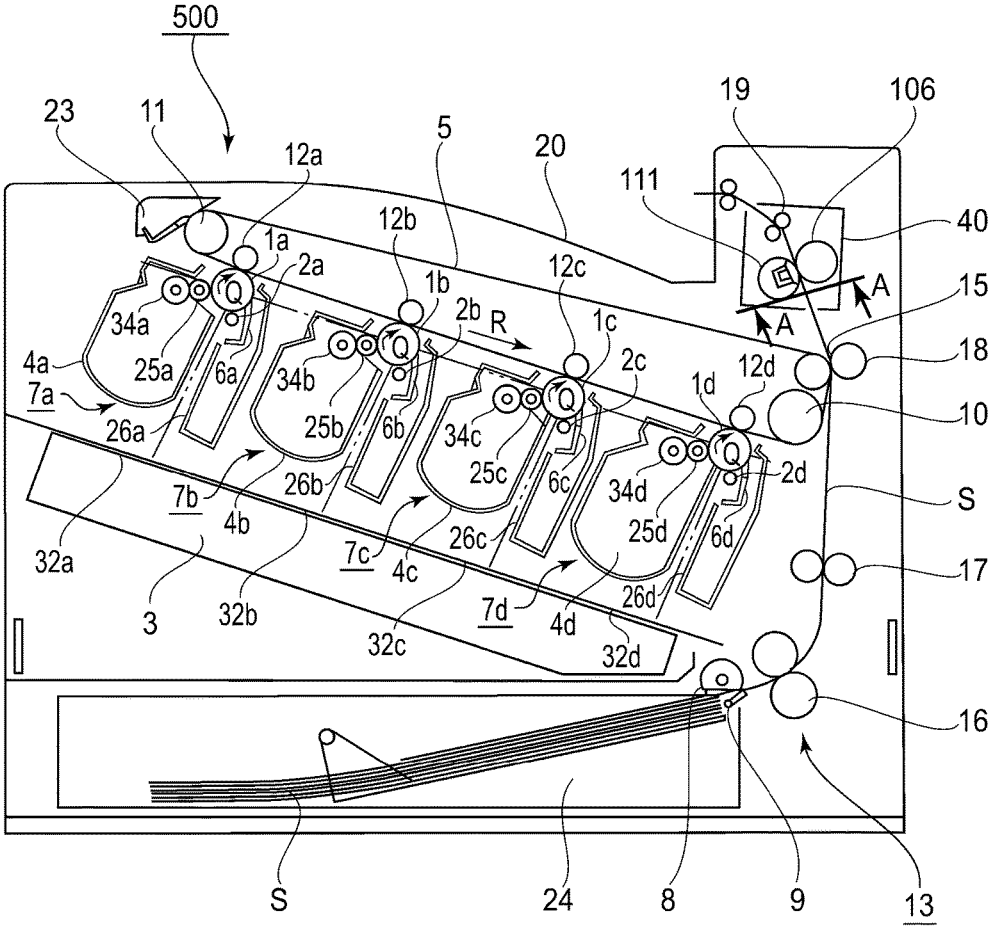
FIG. 2 is a sectional view of the image forming apparatus equipped with the fixing apparatus in accordance with the present invention.
Figure 3:
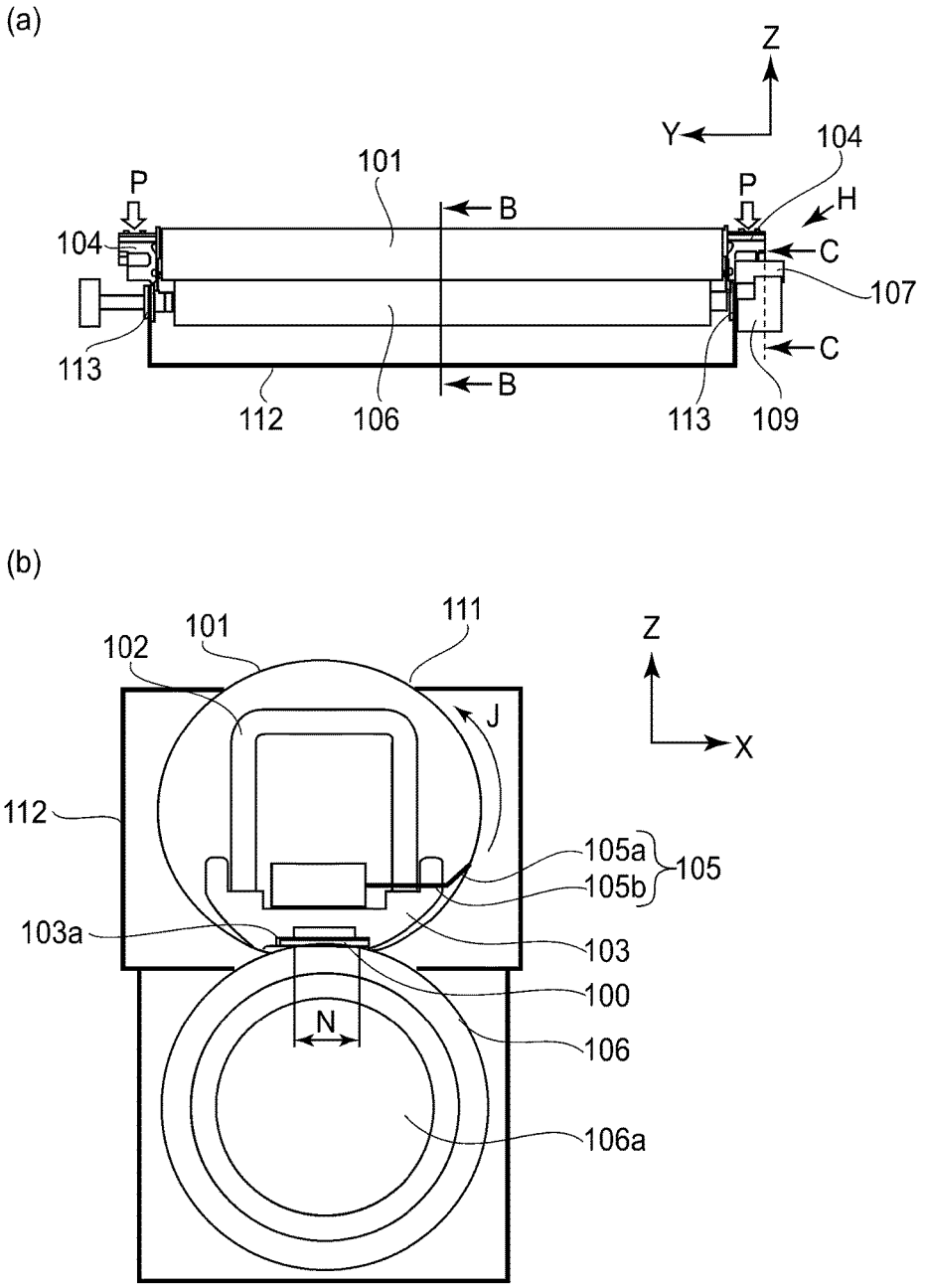

Part (a) of FIG. 3 and part (b) thereof are sectional views of the fixing apparatus in accordance with the present invention, at planes A-A in FIG. 2, and B-B in part (a) of FIG. 3, respectively.

Figure 4:
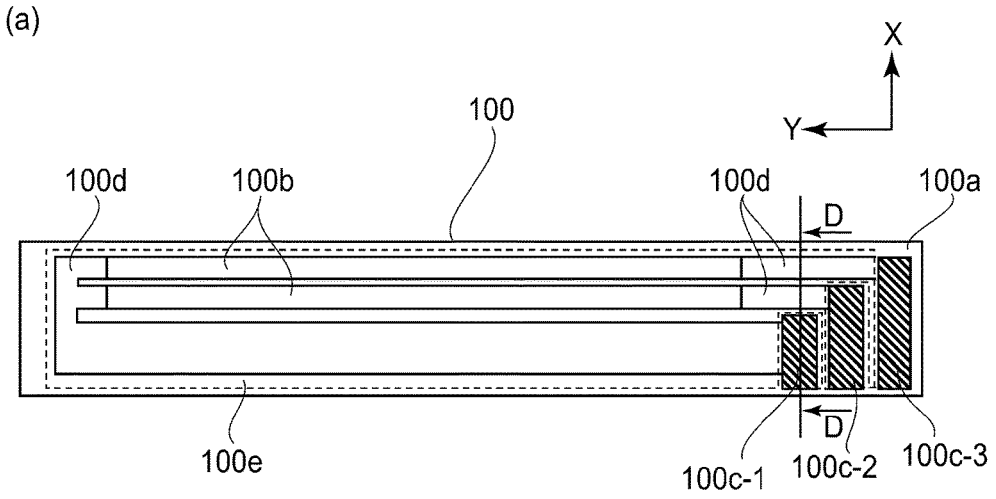
Figure 4:
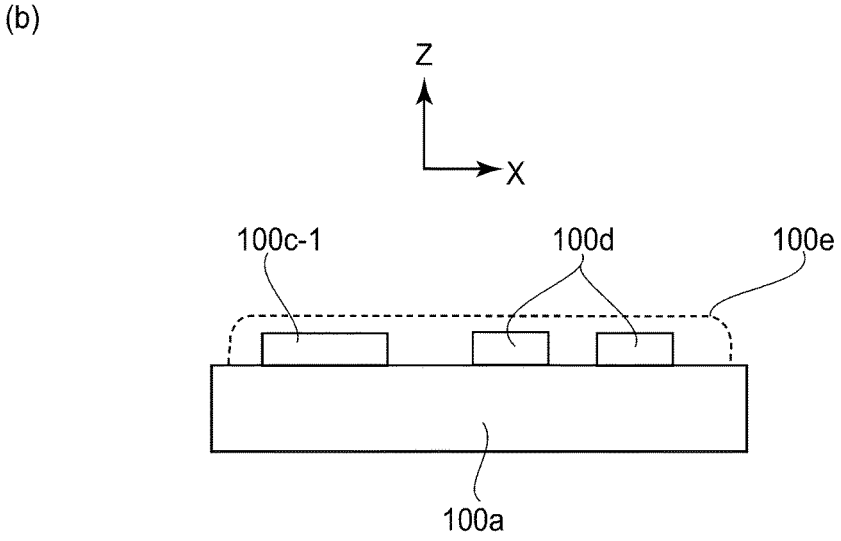

Part (a) of FIG. 4 is a schematic front view of the heater of the fixing apparatus in accordance with the present invention, and part (b) of FIG. 4 is a schematic sectional view of the heater of the fixing apparatus, at a plane D-D in part (a) of FIG. 4.

Figure 5:
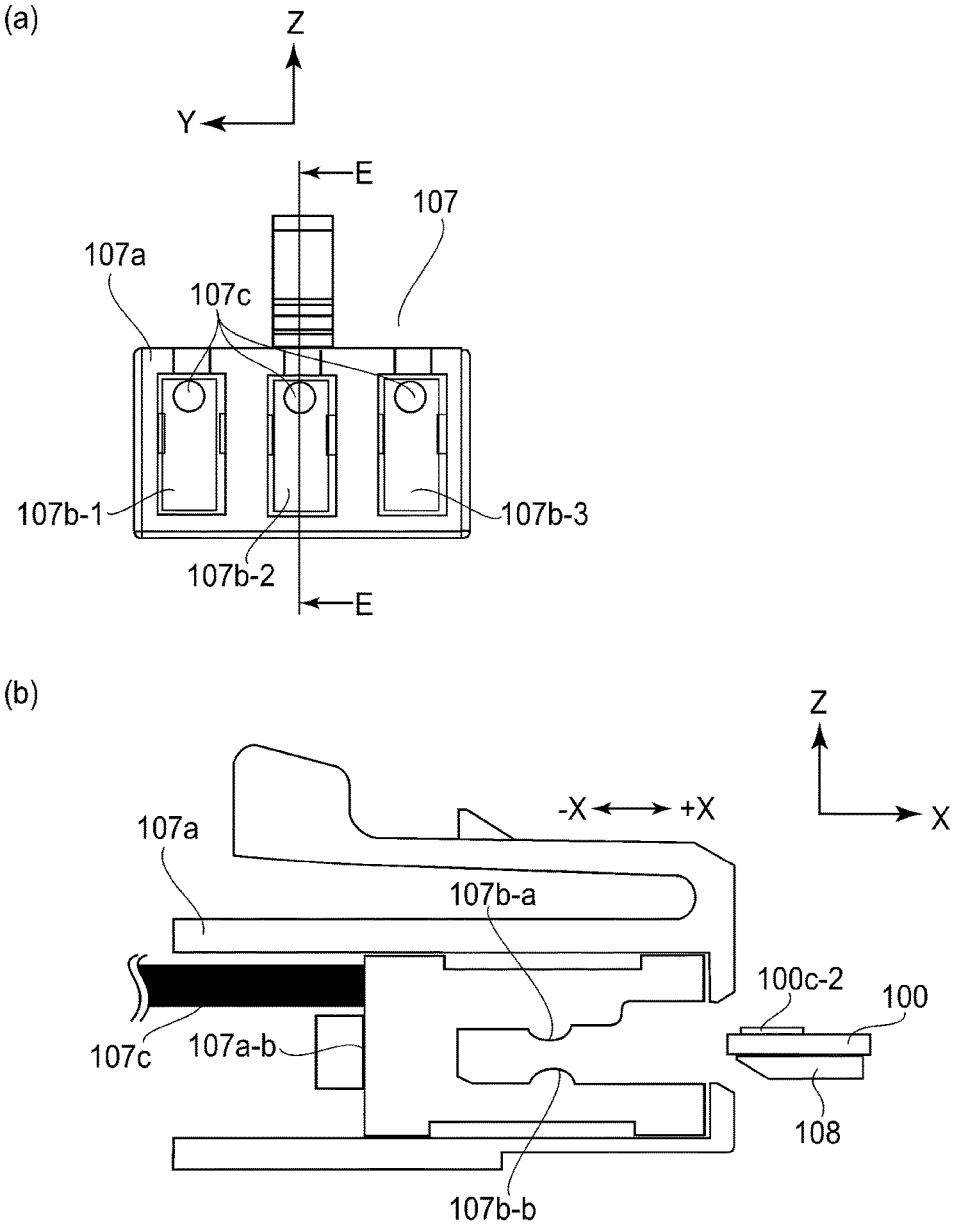

Part (a) of FIG. 5 is a front view of the connector of the fixing apparatus in accordance with the present invention, and part (b) of FIG. 5 is a sectional view of a combination of the connector, heater, and spacer of the fixing apparatus in accordance with the present invention, at a plane E-E in part (a) of FIG. 5.

Figure 6:
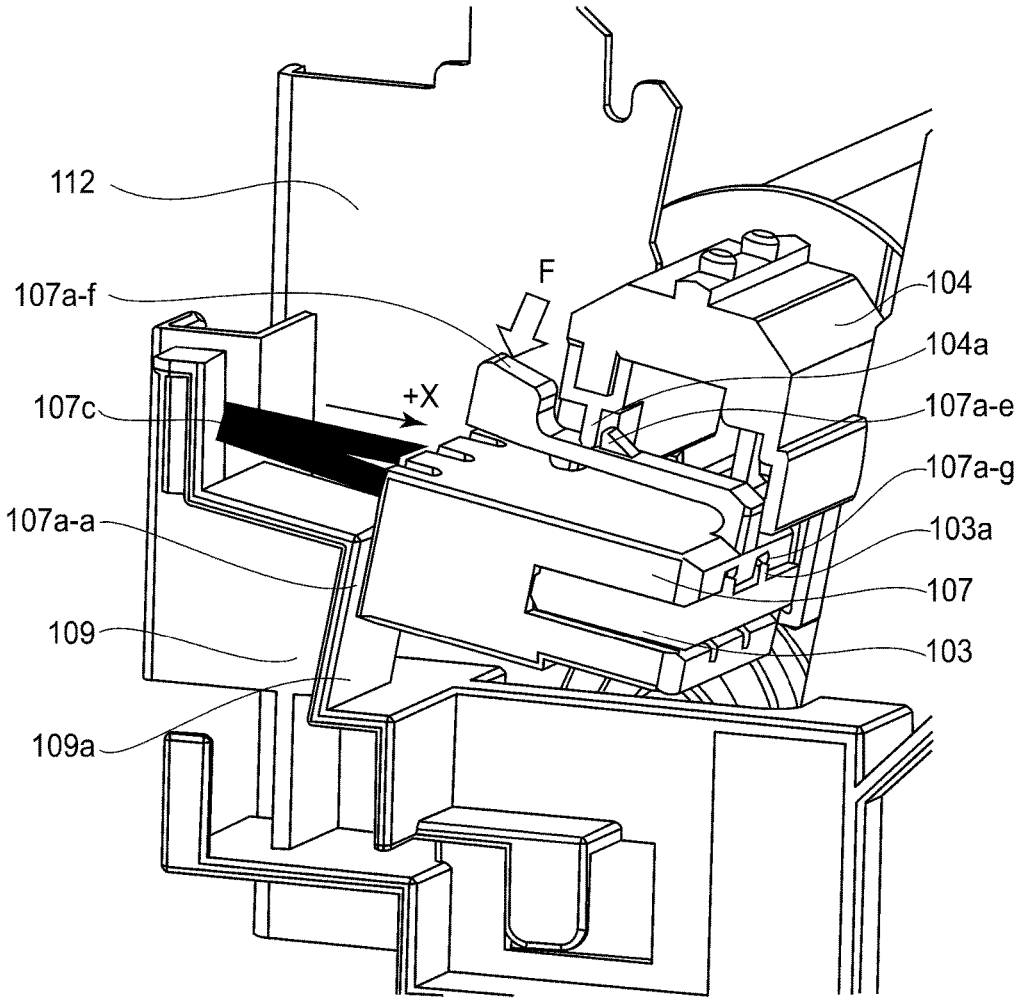

FIG. 6 is a perspective top view of the fixing apparatus in accordance with the present invention, as seen from the direction indicated by an arrow mark H in part (a) of FIG. 3.

Figure 7:
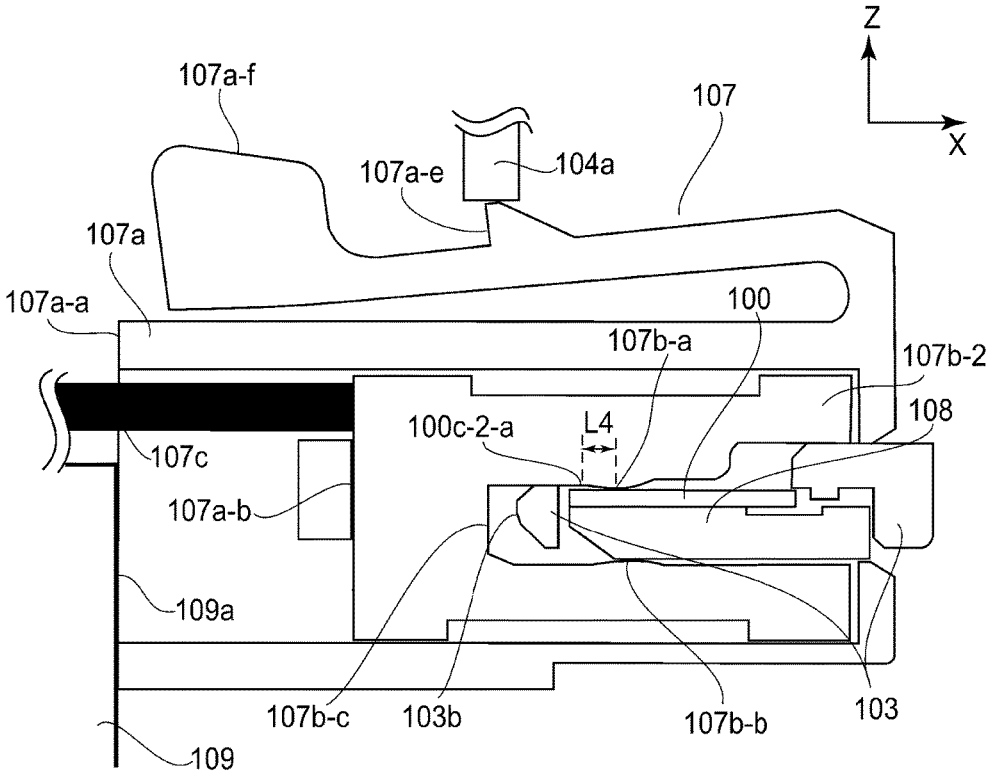

FIG. 7 is a sectional view of a combination of the film unit and guiding member of the fixing apparatus in accordance with the present invention, when the combination is in the second state.

Figure 8:
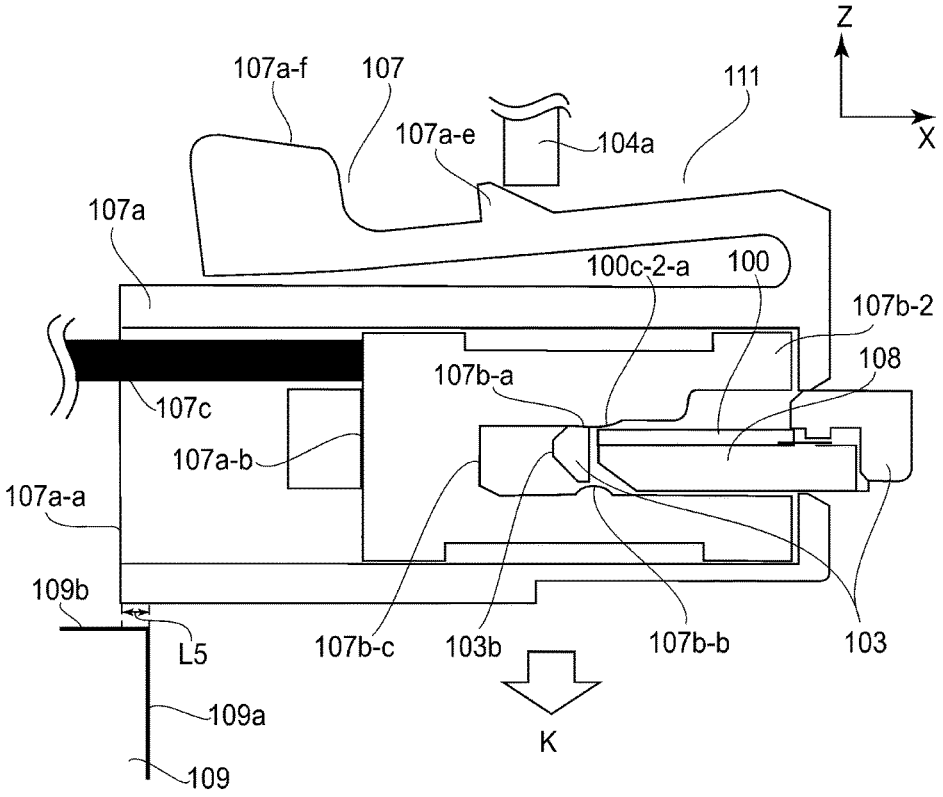

FIG. 8 is a sectional view of the combination of the film unit and guiding member of the fixing apparatus in accordance with the present invention, when the combination is in the third state.

Figure 9:
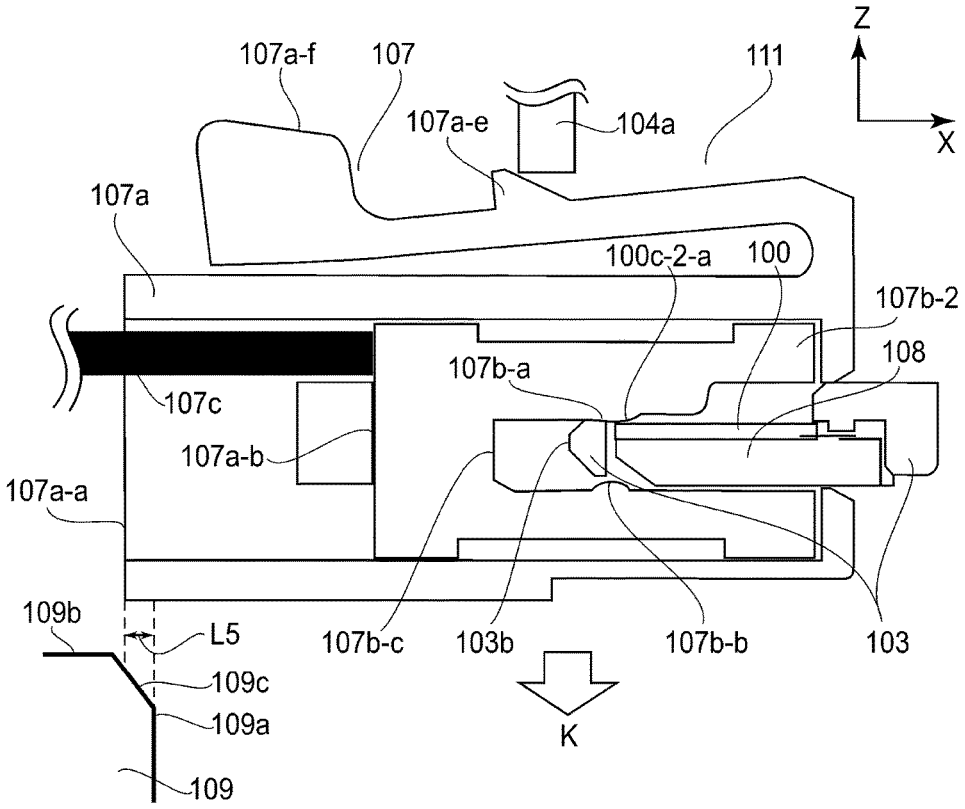

FIG. 9 is a sectional view of the combination of the film unit and guiding member of the fixing apparatus in accordance with the present invention, also when the apparatus is in the third state.

DESCRIPTION OF THE EMBODIMENTS

Hereafter, one of the preferred embodiments of the present invention is described in detail with reference to the appended drawings.

Embodiment 1

(Image Forming Apparatus)

FIG. 2 is a sectional view of the image forming apparatus 500 equipped with a fixing apparatus in accordance with the present invention. Each of the four cartridges 7 (7*a*-7*d*), which are disposed in tandem and parallel in the diagonally downward direction, has: a photosensitive drum unit 26 (26*a*-26*d*, respectively) having a photosensitive drum 1 (1*a*-1*d*, respectively); and a development unit 4 (4*a*-4*d*, respectively).

The photosensitive drum 1 is driven by a driving member (unshown) in the clockwise direction (indicated by arrow mark Q) in FIG. 2. Further, each photosensitive drum unit 26 is provided with a cleaning member 6 (6*a*-6*d*, respectively), a charge roller 2 (2*a*-2*d*, respectively), and a development unit 4 (4*a*-4*d*, respectively), which are disposed in the adjacencies of the peripheral surface of the photosensitive drum 1, listing from the upstream side in terms of the rotational direction of the photosensitive drum 1.

The cleaning member 6 is for removing the toner remaining on the peripheral surface of the photosensitive drum 1, after the formation of a toner image on the peripheral surface of the photosensitive drum 1, and the subsequent transfer of the toner image onto an intermediary transfer film 5. The toner removed by the cleaning member 6 is recovered into the waste toner chamber in the photosensitive member unit 26 (26*a*-26*d*, respectively).

The charge roller 2 is a roller for uniformly charging the peripheral surface of the photosensitive drum 1. After the peripheral surface of the photosensitive drum 1 is charged by the charge roller 2, the peripheral surface of the photosensitive drum 1 is exposed to a beam of laser light projected onto the peripheral surface of the photosensitive drum 1 from a scanner unit 3 (exposing means), through an opening 32 (32*a*-32*d*, respectively), with which the unit 26 is provided. As s result, an electrostatic latent image is formed on the peripheral surface of the photosensitive drum 1. In this embodiment, the scanner unit 3 is disposed on the under side of the combination of the cartridges 7, to expose the peripheral surface of each of the photosensitive drums 1.

The development unit 4 is a unit for supplying the electrostatic latent image formed on the peripheral surface of the photosensitive drum 1, with toner, in order to develop the electrostatic latent image into a visible image. It is provided with a development roller 25 (25*a*-25*d*, respectively) and a supply roller 34 (34*a*-34*d*, respectively). The development roller 25 is for supplying the peripheral surface of the photosensitive drum 1 with toner, by being placed in contact with the peripheral surface of the photosensitive drum 1. The supply roller 34 is for supplying the development roller 25 with toner, by being placed in contact with the peripheral surface of the development roller 25.

The process for forming an image on a sheet S of recording medium (paper) is as follows. First, an electrostatic latent image is formed on the peripheral surface of the photosensitive drum 1 by the scanner unit 3. Then, the latent image is developed by the cartridge 7 into a toner image. Then, the toner image is transferred onto the intermediary transfer film 5.

The intermediary transfer film 5 is suspended and kept tensioned by a combination of a drive roller 10 and a tension roller 11. It is driven in the direction indicated by an arrow mark R in FIG. 2. There are disposed the primary transfer rollers 12 (12*a*-12*d*, respectively) on the inward side of the loop (film loop), which the intermediary transfer film 5 forms. Each primary transfer roller 12 is disposed in a manner to oppose the corresponding photosensitive drum 1 with the presence of the intermediary transfer film 5 between itself and the photosensitive drum 1. To the primary transfer roller 12, transfer bias is applied by an unshown bias applying means. In a case when negatively charged toner is used for development, positive bias is applied to the primary transfer roller 12. As the bias is applied to the primary transfer roller 12, the toner image on the peripheral surface of the photosensitive drum 1 is transferred (primary transfer) onto the intermediary transfer film 5 as if it is peeled away from the photosensitive drum 1. As four toner images, different in color, are sequentially transferred (primary transfer) onto the intermediary transfer film 5, they are layered on the intermediary transfer belt 5. Then, the layered toner images on the intermediary transfer film 5 are conveyed to the secondary transferring portion 15.

In the secondary transferring portion 15, the layered toner images on the intermediary transfer film 5 are transferred (secondary transfer) onto a sheet S of recording medium. The toner remaining on the intermediary transfer film 5 after the secondary transfer is removed by a transfer film cleaning apparatus 23. The removed toner is conveyed through a waste toner passage (unshown), and then, is recovered by a waste toner recovery container (unshown).

Meanwhile, a sheet S of recording medium is conveyed to the secondary transferring portion 15, in synchronism with the progression of the above-described image forming operation, by a sheet conveyance mechanism that is made up of a sheet feeding-conveying apparatus 13, a pair of registration rollers 17, etc. The sheet feeding-conveying apparatus 13 has a feed roller 8 and a pair of sheet conveyance rollers 16. The feed roller 8 is for feeding the sheet S into the main assembly of the image forming apparatus 500. The sheet conveyance rollers 16 are for conveying the sheet S after the sheet S is fed into the main assembly.

The image forming apparatus 500 is structured so that a sheet feeder cassette 24 is removably installable into the main assembly of the apparatus 500. Thus, a user can pull the sheet feeder cassette 24 out of the main assembly of the image forming apparatus 500, and fill (refill) the cassette 24 with a desired number of sheets S of recording medium. As the user inserts the refilled cassette 24 into the main assembly of the image forming apparatus 500, the process of supplying (resupplying) the image forming apparatus 500 with sheets of recording medium is completed. As the cassette 24 is inserted into the main assembly, the topmost sheet S in the cassette 24 is pressed on the feed roller 8. Thus, as the feed roller 8 is rotated, the topmost sheet S is fed into the main assembly while being separated from the rest in the cassette 24 by the coordination of the feed roller 8 and a separation pad 9 (friction-based sheet separation method).

After being conveyed from the sheet feeding-conveying apparatus 13, the sheet S of recording medium is conveyed to the secondary transferring portion 15 by the pair of registration rollers 17. In the secondary transferring portion 15, the four toner images, different in color, on the intermediary transfer film 5 can be transferred (secondary transfer) onto the conveyed sheet S by the application of positive bias to the secondary transfer roller 18.

Then, the sheet S is conveyed from the secondary transferring portion 15 to the fixing apparatus 40, which applies heat and pressure to the transferred image on the sheet S to fix the toner image to the sheet S. After the fixation of the toner images to the sheet S, the sheet S is discharged into a delivery tray 20 by a pair of discharge rollers 19.

(Fixing Apparatus)

Next, the fixing apparatus 40 in this embodiment is described about its structure. The fixing apparatus 40 in this embodiment is such a fixing apparatus that has a fixation film 101 made up of a thin, cylindrical, and metallic substrative layer, and an elastic layer formed on the outward surface of the substrative layer. It is of the so-called film heating type, and also, of the so-called pressure roller driving type. Part (a) of FIG. 3 is a sectional view of the fixing apparatus 40 in this embodiment, at a vertical plane (plane A-A in FIG. 2), which is parallel to the lengthwise direction of the fixing apparatus 40. Part (b) of FIG. 3 is a sectional view of the fixing apparatus 40, at a plane (B-B in part (a) of FIG. 3), which is parallel to the widthwise direction of the fixing apparatus 40.

Referring to part (a) of FIG. 3 and part (b) thereof, the fixing apparatus 40 has a fixation film 101, a pressure roller 106, and a ceramic heater 100 (which may be referred to simply as a heater, hereafter). The fixation film 101 is a fixing member. It is a cylindrical (endless) belt. The pressure roller 106 is a pressure applying member. The ceramic heater 100 is a heating member. The fixing apparatus 40 a pressure bearing member 103, which is disposed on the inward side of the loop (film loop) which the fixation film 101 forms, in a manner to support the heater 100 with the presence of the heater 100 and fixation film 101 between itself and pressure roller 106, and also, to form a nip N between the fixation film 101 and pressure roller 106. Further, the fixing apparatus 40 has a thermistor 105 and a pair of flanges 104. The thermistor 105 is for detecting the temperature of the inward surface of the fixation film 101. The flanges 104 are disposed at the edges of the fixation film 101 to regulate the movement of the fixation film 101 in the lengthwise direction of the fixing apparatus 40.

Moreover, the fixing apparatus 40 has a stay 102 and an electrical connector 107. The stay 102 is disposed on the inward side of the fixation film loop to reinforce the pressure bearing member 103. The connector 107 supplies the heater 100 with the electrical power from the main assembly of the image forming apparatus 500. Further, the fixing apparatus 40 has a spacer 108 (for ensuring that a preset amount of pressure is provided and maintained throughout the nip N as will be described later), which is sandwiched between the connector 107 and heater 100. Further, the fixing apparatus 40 is provided with a guiding member 109, which internally holds one of the lengthwise end of a cable 107*c*, which is in connection to the connector 107 by the other lengthwise end. The guiding member 109 encases and routes the cable 107*c*. It has the function of a regulating member (preventive member). This function is described later.

Hereafter, a combination of the fixation film 101, heater 100, pressure bearing member 103, stay 102 as a part of the mechanism for applying pressure to the pressure bearing member 103, flange 104, thermistor 105, connector 107, and spacer 108 is referred to as a film unit 111. By the way, in this embodiment, the direction in which the connector 107 is to be plugged into the fixing apparatus 40 is referred to as the direction X, and the lengthwise direction of the film unit 111 (which is perpendicular to the recording medium conveyance direction) is referred to as the direction Y. Further, the direction that is perpendicular to the surface of the substrate of the heater 100, on which electrical terminals are formed, and which will be described later with reference to part (a) of FIG. 3, is referred to as the direction Z. By the way, the direction Z in this embodiment is the same as the direction in which the film unit 111 is pressed.

(Pressing Member)

The pressure roller 106 (rotatable member), which is a pressure applying member is made up of a metallic core 106*a*, an elastic layer, and a release layer. The elastic layer is in the form of a hollow roller. It is formed around the peripheral surface of the metallic core 106*a* so that it becomes coaxial with the metallic core 106*a*. It is formed of a heat resistant and an elastic substance such as silicone rubber, fluorine rubber, fluorinated resin, or the like. The release layer is the surface layer of the pressure roller 106. As the material for the release layer, such substances as fluorine resin, silicone resin, fluorosilicone rubber, fluorinated rubber, silicone rubber, PFA, PTFE, FEP, etc., which are excellent in release property and heat resistance, may be selected.

The lengthwise ends of the metallic core 106*a* are fitted with a pair of bearings 113 (part (a) of FIG. 3), one for one, which are made of such a heat resistant resin as PEEK, PPS, liquid polymer, etc., and are rotatably supported by the side plates of the frame 112 of the fixing apparatus 40 (part (a) of FIG. 3). The flanges 104 (part (a) of FIG. 3) are fitted in the lengthwise ends of an assembled combination of the pressure bearing member 103 and stay 102, one for one. Not only do they guide the fixation film 101 as the fixation film 101 rotates, but also, prevent the fixation film 101 from deviating in the lengthwise direction of the fixing apparatus 40.

Referring to part (a) of FIG. 3, the pair of flanges 104 are disposed at the edges of the fixation film 101, one for one. Each flange 104 is pressed in the direction indicated by arrow mark P by a pressure plate (unshown) which is rotatably attached to the frame 112. Thus, the film unit 111 and pressure roller 106 are pressed against each other. Further, as a driving force is transmitted to the pressure roller 106 from an unshown fixation motor disposed in the image forming apparatus 500, the fixation film 101 is rotated by the rotation of the pressure roller 106 in the direction indicated by arrow mark J in part (b) of FIG. 3.

(Fixation Film)

The fixation film 101 (rotatable member) (part (a) of FIG. 3) is a piece of heat resistant cylindrical film, through which heat is transmitted to a sheet S of recording medium. It is loosely fitted around the pressure bearing member 103. In order to reduce the fixation film 101 in thermal capacity to enable the fixing apparatus 40 to quickly start, the fixation film 101 is desired to be no more than 100 μm, preferably, no more than 50 μm and no less than 20 μm, in thickness. As for the material for the fixation film 101, a single layer of heat resistant PTFE, PFA, or FEP, or a two-layer film made up of a base layer formed of polyimide, polyamide, PEEK, PES, PPS, or the like, and a surface layer formed of PTFE, PFA, FEP, or the like, on the outward surface of the base layer, can be used. By the way, it may also be formed of a metallic substance.

(Pressure Bearing Member)

The pressure bearing member 103 is a heat resistant and thermally insulating member. It is a long and narrow member, and is roughly semicircular in cross section. It is disposed on the inward side of the film loop, in such an attitude that its lengthwise direction is perpendicular to the recording medium conveyance direction. As for the material for the pressure bearing member 103, such a substance as phenol resin, polyimide resin, polyamide resin, polyamideimide resin, PEEK resin, PES resin, PPS, resin, PFA, resin, PTFE resin, LCP resin, or the like, which is excellent in thermal nonconductivity and heat resistance, is used.

The pressure bearing member 103 in this embodiment plays the role of backing up the fixation film 101. It provides the nip N, which it forms by being pressed against the pressure roller 106, with a preset amount of internal pressure. Further, it keeps the fixation film 101 stable while the fixation film 101 is rotationally driven. It is provided with a groove 103*a*, which extends in its bottom surface, in the lengthwise direction of the fixing apparatus 40, and in which the ceramic heater 100 is fitted to be supported by the pressure bearing member 103.

(Stay)

The stay 102 is such a member that is placed in contact with the back surface of the pressure bearing member 103 and is made of a relatively soft resin, to prevent the pressure bearing member 103 from flexing in the direction perpendicular to its lengthwise direction, and also, to keep the pressure bearing member 103 correct in shape.

(Thermistor)

The temperature detecting means 105 (which will be referred to as a thermistor, hereafter) detects the temperature of the inward surface of the fixation film 101, and sends (feed-back) the information of the detected temperature to the unshown control circuit. The thermistor 105 has a holding portion (unshown) by which the thermistor 105 is fixed to the pressure bearing member 103. Further, it has a temperature detection element 105*a* that is placed in contact with the inward surface of the fixation film 101 to detect the temperature of the inward surface of the fixation film 101 and an elastic leaf spring 105*b*, which is for providing a preset amount of pressure for keeping the temperature detection element 105*b* in contact with the fixation film 101. This leaf spring is made of stainless steel, and serves as a part of an electrical current conduit between the temperature detection element 105*b* and control circuit, in addition to providing the pressure.

(Heater)

Part (a) of FIG. 4 is a top view of the ceramic heater 100 (which hereafter will be referred to simply as a heater) as a heating member in this embodiment. Part (b) of FIG. 4 is a sectional view of the heater 100, at a plane D-D in part (a) of FIG. 4, which is perpendicular to part (a) of FIG. 4. This heater 100 has a ceramic substrate 100*a*, and two heat generating elements 100*b*. The ceramic substrate 100*a* is electrically nonconductive, and is a piece of long, narrow, and thin plate. The heat generating elements 100*b* are formed on one of the principal surfaces of the substrate 100*a* with the use of past printing, or the like, procedure.

Further, the heater 100 has three electrical terminals 100*c* (100*c*-1, 100*c*-2 and 100*c*-3), which are placed in contact with the electrical terminals of the connector 107, one for one, (which will be described later) to provide electrical connection between the main assembly of the image forming apparatus 100 and heater 100, and electrically conductive portions 100*d* which connect the electrical terminals 100*c* to the heat generating elements 100*b*. In this embodiment, the electrical terminal 100*c*-2 is in connection to one of the first heat generating elements 100*b*-1. The electrical terminal 100*c*-3 is in connection to the second heat generation element 100*b*. The electrical terminal 100*c*-1 is different from the electrical terminal 100*c*-2 (one is positive, and the other is negative). Further, the electrical terminal 100*c*-1 is from the electrical terminal 100*c*-3. The heat generation element 100*b* is such an electrical resistor that generates heat as it is supplied with electrical power from the electrical terminal 100*c*.

Further, the heater 100 has a glass layer 100*e* (contoured by broken line in part (b) of FIG. 4) for protecting heat generation elements 100*b*, in addition to the above-described portions. The heater 100 is made up of these portions. The electrical resistivity of the glass layer 100*e* is in a range of 109-1015 (Ω·m). That is, the glass layer 100*e* is an electrically insulating layer. By the way, in this embodiment, any member of the image forming apparatus 500 and fixing apparatus 40, which is no less than 1009 in electrical resistivity is regarded as an electrically insulating member. The heater 100 in this embodiment described above is small in thermal capacity. Thus, as the heat generation elements 100*b* are supplied with electrical power from the main assembly of the image forming apparatus 500, it quickly increases in temperature.

(Connector)

Figure 1:
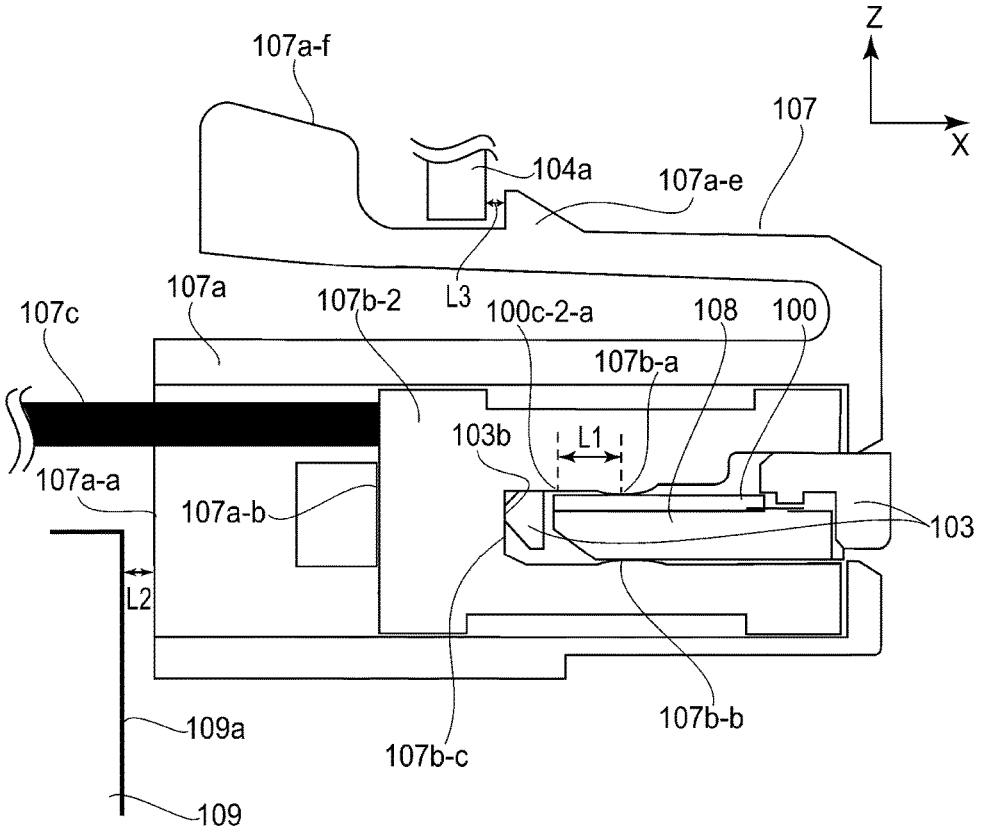
FIG. 1 is a sectional view of a combination of the film unit and guiding member of the fixing apparatus, and the connector for the fixing apparatus, in the first embodiment of the present invention, when the combination is in its first state.

Part (a) of FIG. 5 is a front view of the connector 107 in this embodiment. The connector 107 is made up of a housing 107*a* (holding portion), three electrical terminals 107*b* (107*b*-1, 107*b*-2, and 107*b*-3) (metallic terminals), and three cables 107*c*. The housing 107*a* is formed of such a substance as LCP resin or the like that is dielectric and heat resistant. Further, the three electrical terminals 107*b* (107*b*-1, 107*b*-2, and 107*b*-3) are made of a springy thin plate that is electrically conductive. For example, they are made of thin titanium-copper plate coated with silver, or the like. Each electrical terminal 107*b* is roughly U-shaped in cross section. Referring to FIG. 1, when the connector 107 is in connection to the heater 100, the spacer 108, pressure bearing member 103, ceramic substrate 100*a*, and electrical terminals 103*c* on the substrate 100*a* remain sandwiched by the electrical terminals 107*b* because of the springiness of the electrical terminals 107*b*. One end of each cable 107*c* is in connection to the corresponding electrical terminal 107*b*. The other end of the cable 107*c* is in connection to the power supply portion of the image forming apparatus 500.

Next, referring to part (b) of FIG. 5, which is a sectional view of a combination of the connector 107 and heater, at a plane E-E in part (a) of FIG. 5, the connector 107 and heater 100 are described about their structures related to the electrical connection between them. If the connector housing 107*a* is viewed from the direction Y, it appears roughly U-shaped. The electrical terminals 107*b* of the connector 107 are on the inward side of the U-shaped housing 107*a*. The connector 107 is engaged with the heater 100, which is in the groove 103*a* of the pressure bearing member 103 as a heater holder. Referring to part (b) of FIG. 5, in order for the connector 107 to be engaged with the electrical terminals of the heater 100, the connector 107 is moved in the direction X relative to the combination of the heater 100 and spacer 108. As the connector 107 is moved in the direction X, one (which in this embodiment is 107*b*-*a*) of the pair of the contact portions 107*b*-*a* and 107*b*-*b* of the electrical terminal 107*b* is pressed upon the electrical terminal 100*c* of the heater 100, generating a preset amount of contact pressure between the electrical terminal 107*b* and the electrical terminal 100*c* of the heater 100. Consequently, electrical connection is established between the connector 107 and heater 100.

As for the contact point 107*b*-*b* of the springy electrical terminal 107*b*, that is, the opposite contact point of the electrical terminal 107*b* from the contact point 107*b*-*a* of the electrical terminal 107*b*, comes into contact with the spacer 108. The spacer 108 is provided to ensure that, as it is sandwiched by the heater 100 and contact point 107*b*-*b* of spring electrical terminal 107*b*, a preset amount of pressure is generated and maintained between the electrical terminal 100*c* of the heater 100 and the contact point 107*b*-*a* of the electrical terminal 107*b* of the connector 107. The spacer 108 is formed of such a substance as liquid crystal polymer (LCP) resin that is dielectric and heat resistant.

The positional relationship between the contact point 107*b*-*a* of the electrical terminal 107*b*, and the opposite contact point 107*b*-*b* of the electrical terminal 107*b* from the contact point 107*b*-*a* in terms of the direction Z is determined by a combination of the actual shape of the roughly U-shaped connector housing 107*a*, degree of springiness of the electrical terminal 107*b* of the connector 107, and spacer 108 of the heater 100.

In this embodiment, the above-described electrical terminal 100*c*-1 of the heater 100, shown in part (a) of FIG. 4, contacts the electrical terminal 107*b*-1, which is one of the electrical contact points of the connector 107. Further, the electrical terminal 100*c*-2 of the heater 100 contacts the electrical terminal 1007*b*-2 of the connector 107, which is another point of electrical contact of the connector 107. Similarly, the electrical terminal 100*c*-3 of the heater 100 contacts the electrical terminal 107*b*-3 of the connector 107, which is another point of electrical contact of the connector 107.

Referring to FIG. 6, the connector 107 is provided with a pair of grooves 107*a*-*g*, whereas the pressure bearing member 103 is provided with a pair of protrusive portions 103*a*, which fit into the grooves 107*a*-*g* of the connector 107. The combination of the grooves 107*a*-*g* of the connector 107 and the protrusive portions 103*a* of the pressure bearing member 103 functions as a regulating portion for regulating the position of the connector 107 relative to the heater 100. In terms of the direction Y, the positional relationship between the connector 107 and heater 100 is regulated by this combination of the protrusive portions 103*a* and grooves 107*a*-*g*, in order to prevent the electrical terminals 107*b* of the connector 107 from disengaging from the electrical terminals 100*c* of the heater 100. As the connector 107 is moved in the direction X to be engaged with the heater 100, the protrusive portions 103*a* of the heater 100 fit into the grooves 107*a*-*g* of the connector 107, one for one. That is, as the connector 107 is moved in the direction X, the protrusive portions 103*a* slide into the grooves 107*a*-*g*, one for one.

On the other hand, if the cable 107*c* is pulled in the direction −X, the electrical terminal 107*b* of the connector 107, which is in connection with the cable 107*c*, comes into contact with the surface 107*a*-*b* of the connector housing 107*a*, which is for preventing the electrical terminal 107*b* from disengaging from the electrical terminal 100*c* in the direction −X. That is, as the cable 107*c* is pulled in the direction −X, the tension is transmitted from the electrical terminal 107*b* to the connector housing 107*a*. As a result, the entirety of the connector 107 is moved in the direction −X.

(Connector Lock)

Next, the positional relationship among the connector 107, heater 100, and guiding member 109 (which regulates connector 107 in the movement in unplugging direction (direction −X) is described. First, a case in which an operator replaces the film unit 111 (part (b) of FIG. 3) of the fixing apparatus 40 while the fixing apparatus 40 (image forming apparatus 500) is in a preset state (brand-new film unit 111 is installed). FIG. 1 is a sectional view of a combination of the connector 107 and heater 100, at a plane C-C in part (a) of FIG. 3 (in the case of connector 107, at plane E-E in part (a) of FIG. 5). FIG. 6 is a perspective view of the connector 107 and its adjacencies, as seen from the direction indicated by an arrow mark H in part (a) of FIG. 3.

Referring to FIG. 1, the connector 107 has been moved in the direction X relative to the heater 100, to a preset position, in which the electrical terminals of the connector 107 are electrically in connection with the electrical terminals of the heater 100 (this state of the connector 107 will be referred to as a first state, hereafter). Next, the positional relationship among the connector 107, pressure bearing member 103, flange 104, heater 100, and guiding member 109 when the connector 107 is in the first state is described.

The guiding member 109 in this embodiment is formed of heat resistant polyphenylene sulfide (PPS) resin, or the like. It is fixed to the frame 112 of the fixing apparatus 40 (part (b) of FIG. 3). Not only does it play the role of routing the cable 107*c* of the connector 107 (it encloses cable 107*c* as shown in FIG. 6), but also, the role of a regulating member for regulating the displacement of the connector 107 (direction −X, or first direction) (FIG. 1).

Referring to FIG. 1, when the combination of the connector 107 and fixing apparatus 40 is in the first state, the connector contacting surface 103*b* of the pressure bearing member 103 is in contact with the surface 107*b-c* of each electrical terminal 107*b* of the connector 107. Thus, the connector contacting surfaces 103*b* of the pressure bearing member 103, and the surface 107*b-c* of the electrical terminal 107*b* of the connector 107, function as the stoppers for preventing the connector 107 from moving in the direction +X. Referring to FIG. 1, the locking portion 107*a-e*, with which the connector housing 107*a* is provided to prevent the connector 107 from disengaging in the direction −X faces the locking portion 104*a*, with which the flange 104 is provided to prevent the connector 107 from disengaging in the direction −X. The distance, in terms of the direction −X (or +X), between these two portions 107*a-e* and 104*a* is L3 (FIG. 1), which is shorter than a distance L2, which is the distance between the guiding member 109 and connector 107 in terms of the direction −X (or +X). The combination of the locking portions 107*a-e* and 104*a* functions as a regulating portion for regulating the movement of the connector 107 in the disengagement direction, from the position in which the movement of the connector 107 is regulated by the stopper. When the position of the connector 107 is under the regulation by the locking portions 107*a-e* and 104*a*, the electrical terminals 107*b* of the connector 107 remain in contact with the electrical terminals 100*c* of the heater 100.

Regarding also the positional relationship between the connector 107 and heater 100, when the connector 107 and heater 100 are in the first state shown in FIG. 1, the contact point 107*b-a* of each of the springy electrical terminals 107*b* of the connector 107 is in contact with the electrical terminal 100*c* of the heater 100. The electrical terminal 100*c* is provided with an area that extends in the direction X in part (a) of FIG. 4. When the connector 107 is in the first state, the first position in which the contact point 107*b-a* of the springy electrical terminal 107*b* contacts the electrical terminal 100*c* of the heater 100 holds a distance of L1 from the edge 100*c-a* of the electrical terminal 100*c* in terms of direction −X (FIG. 1).

Referring to FIG. 1, in this embodiment, the electrical terminals of the connector 107 can remain in contact with the electrical terminals of the heater 100 within a range, in terms of the direction −X, which is between the first position in which the electrical terminals of the connector 107 contact the electrical terminals of the heater 100 when the connector 107 is plugged into the heater 100 all the way, and the second position in which the electrical terminals of the connector 107 contact the upstream ends of the electrical terminals of the heater in terms of the direction −X. This range is a range L1 in FIG. 1.

Further, regarding the positional relationship between the connector 107 and guiding member 109, when the relationship is in the first state shown in FIG. 1, the distance between the end surface 107*a-a* of the connector 107*a*, and the surface 109*a* of the guiding member 109 is L2, in terms of the direction −X. In this embodiment, the following relationship is satisfied between L1 and L2.

$$L1>L2$$

Next, a state (which is referred to as a second state, hereafter) in which the connector 107 is limited by the guiding member 109, as a regulating member, in its movement in the direction (direction −X) to be unplugged, is described. FIG. 7 is a combination of a sectional view of the guiding member 109 at a plane C-C in part (a) of FIG. 3, and a sectional view of the connector 107 at a plane E-E in part (a) of FIG. 5 when the connector 107 and guiding member 109 are in the second state.

Regarding this state, it is possible for an operator to inadvertently apply force to the surface 107*a-f* of the connector 107 in the direction indicated by an arrow mark F, as shown in FIG. 6, as the operator grasps the film unit 111 while the operator is replacing the film unit 111 of the fixing apparatus 40. If the operator applies the force, the locking portion 107*a-e* of the connector housing 107*a* is moved in the direction indicated by the arrow mark F, that is, in the direction to be disengaged from the locking portion 104*a* of the flange 104, as shown in FIG. 6. Consequently, the locking portion 107*a-e* becomes disengaged from the locking portion 104*a*, unlike in the first state.

Moreover, it is possible that when the film unit 111 is in the frame 112 of the fixing apparatus 40, the cable 107*c* will be routed in such a manner that the cable 107*c* is pulled in the direction −X. If the cable 107*c* is pulled in such a manner, the connector terminal 107*b*, which is in connection with the cable 107*c* moves in the direction −X, because the connector 107 is not in engagement with the flange 104. As a result, the entirety of the connector 107 moves in the direction in which the connector 107 is unplugged, relative to the position in which the connector 107 is when it is in the first state. In other words, the positional relationship among the connector 107, pressure bearing member 103, flange 104, heater 100, and guiding member 109 is put in the second state.

Next, referring to FIG. 7, the positional relationship among the connector 107, pressure bearing member 103, flange 104, heater 100, and guiding member 109 when the relation is in the second state is described. When the relationship is in the second state, the connector contacting surface 103*b* of the pressure bearing member 103 is not in contact with the surface 107*b-c* of the electrical terminal 107*b* of the connector 107. Rather, they are separated from each other in terms of the direction X. However, the electrical terminal 107*b* remains sandwiching the ceramic substrate 100*a* of the heater 100, and the spacer 108, as shown in FIG. 7.

Further, when the relationship is in the second state, the positional relationship between the connector 107 and flange 104 is such that the connector 107 is in a position into which it has moved in the direction −X, from the position (FIG. 1) in which it was when the relationship was in the first state. Further, the locking portion 104*a* of the flange 104 is not in engagement with the locking portion 107*a-e* of the connector housing 107*a*, as shown in FIG. 7.

Further, the positional relationship between the connector 107 and guiding member 109 is such that the end surface 107*a-a* of the connector housing 107*a* in terms of the direction −X is in contact with the surface 109*a* of the guiding member 109, which regulates the movement of the connector 107 in the direction −X. That is, when the positional relationship is in the second state, distance L2 (FIG. 1) is zero (L2=0).

In the first state, L1>L2. Therefore, even after L2 became zero (L2=0), L4, which is the distance between the area of contact between the contact point 107*b-a* of the springy electrical terminal 107*b* and the edge 100*c*-2-*a* of the electrical terminal 100*c*-2, shown in FIG. 7, is greater than zero (L4>0). That is, the positional relationship between the connector 107 and heater 100 is such that, in terms of the direction −X, the distance L4 (L4=L1−L2) between the contacting portion 107*b-a* of the springy electrical terminal 107*b* and the end portion 100*c-a* of the electrical terminal 100*c* of the heater 100 is greater than zero (L4>0).

Therefore, even when in the second state, in which the connector 107 is in contact with the guiding member 109, and therefore, is not allowed to move further in the direction −X, the electrical terminal 107*b* of the connector 107 remains in contact with the electrical terminal 100*c* of the heater 100. Thus, it does not occur that an operational error committed by an operator puts the connector 107 and heater 100 in such a state that the electrical terminal of the connector 107 cannot remain in contact with the electrical terminal 100*c* of the heater 100.

Next, a state in which the connector 107 has moved in the unplugging direction (direction −X) more than distance L2 (first state) before the film unit 111 is inserted into the frame 112 in an operation for replacing the film unit 111 is described (this state will be referred to as a third state, hereafter). FIG. 8 is a combination of a sectional view of the heater 100 at a plane perpendicular to its lengthwise direction, a sectional view of the guiding member 109, and a sectional view of the center portion of the connector 107 (at plane E-E in part (a) of FIG. 5), before the film unit 111, the lengthwise direction of which is parallel to the direction that is perpendicular to the sheet of paper on which FIG. 8 is, is inserted into the unshown frame 112 of the fixing apparatus 40.

When the combination of the connector 107, heater 100, and guiding member 109 is in the third state, shown in FIG. 8, the surface 107*a-a* of the connector 107 is on the downstream side of the surface 109*a* of the guiding member 109, which is for regulating (limiting) the movement of the connector 107 in the direction −X, by a distance L5 in terms of the direction −X. That is, in terms of the vertical direction, the connector 107 overlaps with the guiding member 109 by the distance L5. When the combination is in third state, the electrical terminal 107*b* of the connector 107 remains sandwiching the ceramic substrate 100*a* of the heater 100, and the space 108. However, the contact point 107*b-a* of the springy electrical terminal 107*b* is in contact with a dielectric portion, that is, the glass layer 100*e* of the heater 100, spacer 108, or pressure bearing member 103. That is, the electrical terminal 107*b* remains sandwiching the ceramic substrate 100*a* of the heater 100, and the spacer 108. However, the contacting portion 107*b-a* is not in contact with the electrical terminal 100*c* of the heater 100. In other words, the combination is in such a state in which there is no electrical connection between the heater 100 and connector 107. If an operator tries to insert the film unit 111 into the frame 112 of the fixing apparatus 40 in the direction indicated by an arrow mark K in FIG. 8 while the combination is in the state shown FIG. 8, the connector housing 107*a* comes into contact with the surface 109*b* of the guiding member 109 by an amount that is equivalent to the distance L5 in terms of the direction X. Thus, the operator will notice that the connector 107 has moved (displaced) from its preset position in the unplugging direction.

The foregoing description of the preferred embodiment of the present invention can be summarized as follows.

When the positional relationship between the connector 107 and heater 100 is in the first state, the guiding member 109 and connector 107 do not interfere with each other. Therefore, the film unit 111 can be attached to the side plates of the frame 112 of the fixing apparatus 40. Further, the electrical terminal 107*b* of the connector 107 is in contact with the electrical terminal 100*c* of the heater 100, and therefore, the heater 100 can be supplied with electricity.

Even if the connector 107 is moved relative to the heater 100 in the unplugging direction (direction −X), the guiding member 109 does not interfere with the connector 107 unless the locking portion 107*a-e* of the connector 107 becomes unlocked from the locking portion 104*a* of the flange 104 of the fixing apparatus 40. Therefore, it is possible to attach the film unit 111 to the side plates of the frame 112. Further, the electrical terminal 107*b* of the connector 107 and the electrical terminal 100*c* of the heater 100 are in connection with each other, and therefore, the heater 100 can be supplied with electrical power.

On the other hand, in a case when the locking portion 107*a-e* of the connector 107 became unlocked from the locking portion 104*a* of the flange 104 of the fixing apparatus 40, and therefore, the connector 107 moved from the position in which it was when the connector 107 and heater 100 were in the first state, the guiding member 109 and connector 107 do not interfere with each other until the positional relationship between connector 107 and heater 100 changes from the first one to the second one. Therefore, the film unit 111 can be attached to the side plates of the frame 112 with no interference from the connector 107. While the positional relationship between the connector 107 and heater 100 changes from the one in the first state to the one in the second state, the electrical terminal 107*b* of the connector 107 and the electrical terminal 100*c* of the heater 100 remain in contact with each other, the heater 100 to be supplied with electrical power.

However, if the locking portion 107*a-e* of the connector 107 becomes unlocked from the locking portion 104*a* of the flange 104 of the fixing apparatus 40, the connector 107 may move relative to the heater 100 in the unplugging direction by a distance that is longer than the distance L1. In such a case, the positional relationship between the connector 107 and the heater 100 turns into the one in the third state. Thus, the electrical terminal 107*b* of the connector 107 does not contact the electrical terminal 100*c* of the heater 100, even though the connector 107 remains sandwiching the heater 100 (or spacer 108). When the positional relationship between the connector 107 and heater 100 is in this state, the guiding member 109 interferes with the connector 107, and therefore, the film unit 111 cannot be attached to the side plates of the frame 112 of the fixing apparatus 40.

As described above, this embodiment makes an operator notice that the connector 107 is unplugged (no electrical connection between connector 107 and heater 100), before the operator begins to replace the film unit 111. Therefore, such an error does not occur that an operator notices the error (no electrical connection between connector and heater) after the operator starts up the main assembly of the image forming apparatus after the replacement of the film unit 111. That is, the present invention can prevent the above-described error that occurs which a conventional image forming apparatus.

According to the present invention described above with reference to the preferred embodiment of the present invention, a distance the connector for a fixing apparatus is allowed to move in the direction to be unplugged after the proper attachment of the film unit to the main assembly of the fixing apparatus is limited to a range in which the electrical terminal of the connector remains in contact with the electrical terminal of the heater. Further, if the connector is outside of this range, the present invention makes an operator notice that the connector is not in this range, before the operator begins to attach the film unit to the frame of the fixing apparatus.

In other words, the present invention can prevent the occurrence of such an operational error that during an operation for replacing the film unit of a fixing apparatus, an operator reinstalls the film unit without noticing that the operator accidentally moved the connector out of the range in which the electrical terminals of the connector remain in contact with the electrical terminals of the heater. Thus, the present invention can reduce a fixing apparatus (image forming apparatus) in downtime, and also, improves a fixing apparatus (image forming apparatus) in reliability.

In the foregoing, the positional relationship between the connector 107 and heater 100 was described with reference to part (a) of FIG. 5, a part of which is a sectional view of the connector 107 at a plane E-E in part (a) of FIG. 5. That is, the positional relationship between the electrical terminal 107*b*-1 of the connector 107 and the electrical terminal 107*b*-2 of the heater 100 was described. By the way, when the positional relationship between the connector 107 and heater 100 is in the first, second, and third states, the positional relationship between the electrical terminals 100*c*-1 and 100*c*-3, and the electrical terminals 107*b*-1 and 107*b*-2, respectively, are the same as that between the electrical terminal 100*c*-2 of the heater 100 and the electrical terminal 107*b*-2 of the connector 107. That is, when the connector contacting surface 103*b* of the pressure bearing member 103 is in contact with the surface 107*b*-*c* of the connector 107, the electrical terminals 100*c*-1 and 100*c*-3 of the heater 100 also are in contact with the electrical terminals 107*b*-1 and 107*b*-2 of the connector 107, respectively. Further, if the locking portion 107*a*-*e* of the connector 107 is unlocked from the locking portion 104*a* of the flange 104 of the fixing apparatus 40, and therefore, the connector 107 moves relative to the heater 100 in the unplugging direction from the position in which it is when it was in the first state, the guiding member 109 does not interfere with the connector 107 until the state of their positional relationship changes to the second one. Therefore, the film unit 111 can be attached to the side plates of the frame 112 of the fixing apparatus 40. While the state of the positional relationship between the connector 107 and heater 100 changes from the first one to the second one, the electrical terminals 100*c*-1 and 100*c*-2 of the heater 100 also remain in contact with the electrical terminals 107*b*-1 and 107*b*-2, respectively. All that is necessary to find out whether there is electrical connection between the electrical terminals 100*c* of the heater 100 and the electrical terminals 107*b* of the connector 107, one for one, is to find out whether or not the film unit 111 can be installed or not.

Lastly, referring to FIG. 9, a case in which the guiding member 109 is provided with a slant surface 109*c* that connects the surfaces 109*a* and 109*b* of the guiding member 109 is described. In this case, when the connector 107 and guiding member 109 are in the third state, the surface 107*a*-*a* of the connector 107 is on the downstream side of the surface 109*a* of the guiding member 109 by a distance L5. Thus, if an operator tries to insert the film unit 111 into the frame 112 of the fixing apparatus 40 in the direction indicated by an arrow mark K in FIG. 9, the connector housing 107*a* comes into contact with the slanted surface 109*c* of the guiding member 109, because the guiding member 109 is provided with the slanted surface 109*c*.

However, as the film unit 111 is moved in the direction indicated by the arrow mark K, and the connector housing 107*a* comes into contact with the slanted surface 109*c* of the guiding member 109 (regulating member), the connector housing 107*a* is guided by the slanted surface 109*c*. Thus, the connector housing 107*a* is moved in the direction X until the upstream surface 1007*a*-*a* of the connector 107 in terms of the direction −X comes to the position in which it contacts the surface 109*a* of the guiding member 109. As a result, the electrical terminals 107*b* of the connector 107 are enabled to come into contact with the electrical terminals 100*c* of the heater 100.

According to the present invention, which is related to the structure of the combination of the fixing apparatus and the electrical connector 107 for the fixing apparatus, the displacement of the connector in the unplugging direction can be kept within the range in which the electrical terminals of the connector remain in contact with those of the heater, one for one.

Therefore, such a situation that an operator notices that the connector is not in the range in which the electrical terminals of the connector are not in the range in which they remain in contact with the electrical terminals of the heater, and therefore, the operator has to insert the connector further into the fixing apparatus, does not occur. Thus, the present invention can reduce downtime of the fixing apparatus (image forming apparatus).

MODIFICATIONS

In the foregoing, the present invention was described with reference to one of the preferred embodiments. However, the discussion is not intended to limit the present invention in scope. That is, the present invention is also applicable to various modified versions of the fixing apparatus (image forming apparatus) in the preceding embodiment.

Modification 1

In the above-described embodiment of the present invention, the fixing apparatus was structured so that its heater is supplied with electrical power from only one of the lengthwise ends of the heater. However, the present invention is also compatible with a fixing apparatus structured so that its heater is supplied with electrical power through the connectors from both lengthwise ends of the heater.

Modification 2

In the above-described embodiment of the present invention, it was assumed that it is the fixing apparatus that is provided with the guiding member 109 as a regulating member. However, the present invention is also applicable to a fixing apparatus (image forming apparatus) structured so that the guiding member 109 as a regulating member is outside of the fixing apparatus (within the main assembly of image forming apparatus).

Modification 3

In the above-described embodiment of the present invention, the electrical terminals of the heater as a heating member, were provided with an area that is longer than the opposing contacting portion of the connector, in terms of the first direction, or the unplugging direction. However, the present invention is also compatible to a combination of a connector and a heater, which is structured so that the electrical terminal of the connector is provided with a contact area that is longer than the opposing contact area of the electrical terminal of the heater, in terms of the unplugging direction. That is, all that is required of a combination of a fixing apparatus and the electrical connector in order for the present invention to be applicable to the combination is that at least the electrical terminals of the heater or those of the connector have a contact area that is extensive in the first direction, or the unplugging direction.

Modification 4

In the above-described embodiment of the present invention, the direction in which the connector 107 is connected to, or disconnected from, the heater 100 was perpendicular to the lengthwise direction (direction X; widthwise direction of heater 100) of the fixation film 101. However, the present invention is also applicable to a fixing apparatus (or image forming apparatus) structured so that the direction in which the connector 107 is moved to be connected to, or disconnected from, the heater 100 is parallel to the lengthwise direction of the fixation film 101. In such a case, the shape of the connector 107 may be the same as the one in the preceding embodiment. However, the direction in which the multiple electrical terminals 100*c* of the heater 100 formed on the ceramic substrate 100*a* extend should be perpendicular to the one in the preceding embodiment.

Modification 5

In the above-described embodiment of the present invention, the connector housing 107*a* was like a trough, which was U-shaped in the cross section at a plane perpendicular to the direction Y, and was open on the upstream side in terms of the direction +X. However, the present invention is also compatible with any connector housing as long as it is shaped so that its electrical terminals can sandwich the ceramic substrate 100*a* of the heater 100 and/or spacer 108. For example, the present invention is also compatible with a connector housing that is rectangular (or square) in cross section at a plane perpendicular to the direction Y, and is structured so that the connector 107 is attached to the heater 100 from the direction −Y.

Modification 6

In the above-described embodiment of the present invention, an endless belt was employed as the rotatable fixing member, and a pressure roller was employed as the member that opposes the endless belt. However, the present invention is also applicable to a fixing apparatus structured so that an endless belt is employed as the rotatable fixing member as well as the member that opposes the fixing member.

Further, in the above-described embodiment of the present invention, the endless belt, as a rotatable member, was pressed by the pressure roller as the member that opposes the endless belt. However, the preceding embodiment is not intended to limit the present invention in scope. For example, the present invention is also applicable to a fixing apparatus structured so that a member that opposes an endless belt, as a rotatable fixing member, is pressed by the endless belt.

Modification 7

In the above-described embodiment of the present invention, the fixing apparatus was provided for fixing an unfixed toner image to a sheet of recording medium. However, the preceding embodiment is not intended to limit the present invention. For example, the present invention is also applicable to an apparatus (which also is referred to as fixing apparatus) for pressing and heating a toner image in order to improve the image in gloss, after the toner image is temporarily fixed to a sheet of recording medium.

Modification 8

In the above-described embodiment of the present invention, the fixing apparatus was provided with multiple (two) heat generating members, as heating members, disposed in tandem in the recording medium conveyance direction. However, the compatibility of the present invention is not limited to a fixing apparatus having two heat generating members. For example, the present invention is also compatible to a fixing apparatus having three or more heat generating members disposed in tandem in the recording medium conveyance direction. Further, the present invention is also compatible with a fixing apparatus having only one heat generating member.

Modification 9

In the above-described embodiment of the present invention, the recording medium was described as being a sheet of recording paper. However, the preceding embodiment is not intended to limit the present invention in terms of the type of recording medium usable by an image forming apparatus to which the present invention is applied. Generally speaking, the term "recording medium" means a sheet of any substance on which a toner image can be formed by an image forming apparatus. It includes a sheet of ordinary paper, glossy paper, cardstock, thin paper, resinous substance, overhead projector (OPH) film, an envelope, etc.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image heating apparatus comprising:

a first rotatable member;

a second rotatable member cooperative with said first rotatable member to form a nip configured to heat a toner image on a recording material;

a first supporting plate provided with a first groove portion rotatably supporting said second rotatable member at a first end portion side with respect to a longitudinal direction of said second rotatable member;

a second supporting plate provided with a second groove portion rotatably supporting said second rotatable member at a second end portion side with respect to the longitudinal direction, the second end portion side being opposite to the first end side portion;

a heater unit including said second rotatable member, a heater configured to heat said second rotatable member, a connector mounted to said heater by movement relative to said heater in a first direction, a stopper portion configured to stop the relative movement of said connector relative to said heater in the first direction, said heater unit being mounted on said first supporting plate and said second supporting plate in a state that said heater unit is mounted to said heater, wherein said heater includes a heat generating element capable of generating heat by electrical power supply thereto, a first electrode portion provided on a substrate at the first end portion side and configured to supply the electrical power to said heat generating element, and a second electrode portion of a polarity different from that of said first electrode portion, wherein said connector includes a metal terminal cooperative with said first electrode portion to constitute an electrical connection point for the electrical power supply to said heat generating element, by sandwiching the substrate, wherein said stopper portion is configured to stop the relative movement between a connector in the first direction at a first position, at which the electrical connection point is constituted by said metal terminal and said first electrode portion, said first electrode portion extends over a predetermined distance from said electrical connection point constituted by said metal contact and said first electrode portion at the time when said connector is in the first position, in a second direction that is opposed to the first direction, and said metal contact becomes out of electrical contact with said first electrode portion in a state that said metal contact sandwiches the substrate at the second position, when said connector is moved from the first position in the second direction relative to said heater in a state of said metal terminal sandwiching the substrate; and a blocking portion fixed on said first supporting plate, wherein said blocking portion permits said heater unit to be mounted to said first supporting plate and said second supporting plate in a state that said connector is in the first position relative to said heater, and said blocking portion prevents said heater unit from being mounted to said first supporting plate and said second supporting plate in a state that said connector is in the second position relative to said heater.

2. An apparatus according to claim 1, wherein, when said connector is in the first position or in a position between the first position and said second position, relative to said heater, said metal contact cooperates with said first electrode portion to constitute the electrical connection point, and said blocking portion permits said heater unit to be mounted to said first supporting plate and said second supporting plate.

3. An apparatus according to claim 2, wherein said second electrode portion is disposed in the first end portion side with respect to the longitudinal direction, said connector includes a second metal contact constituting, by contacting said second electrode portion, a second electrical connection point for supplying the electrical power to said heat generating element, and said second metal contact and said second electrode portion constitute the second electrical connection point when said connector is between the first position and the second position relative to said heater.

4. An apparatus according to claim 2, wherein said heater includes a third electrode portion provided on the substrate at the first end portion side configured to supply the electrical power to said second heat generating element, said connector includes a second metal terminal constituting a second electrical connection point of supplying the electrical power to said second heat generating element by contacting said third electrode portion, and, when said connector is between the first position and the second position relative to said heater, said second metal contact and said third electrode portion constitute the second electrical connection point.

5. An apparatus according to claim 2, wherein said heater includes a plurality of electrode portions including said first electrode portion and said second electrode portion, said connector includes a plurality of metal contacts constituting electrical contacts by contacting all of the electrodes that are provided at the first end portion side, and, when said connector is between the first position and the second position, said metal terminals and all of said electrode portions constitute the electrical connection points.

6. An apparatus according to claim 1, wherein said heater unit includes a regulating portion configured to regulate the relative movement of said connector in the second direction, when said connector is in the first position relative to said heater, wherein the relative movement from the first position to the second position occurs when said connector is free of regulation of said regulating portion.

7. An apparatus according to claim 1, further comprising a regulating portion configured to regulate the relative position of said connector relative to said heater with respect to a third direction parallel to the substrate and perpendicular to the first direction, so that said metal terminal is cooperative with said first electrode portion to constitute the electrical connection point at the first position.

8. An apparatus according to claim 1, wherein said blocking portion is made of a resin material and is integrally molded with a guide portion configured to guide a position of a cable extending from said connector.

9. An apparatus according to claim 1, wherein said heat generating element, said first electrode portion, and said second electrode portion are provided on the substrate.

10. An apparatus according to claim 1, wherein the second direction is substantially perpendicular to the longitudinal direction.

11. An apparatus according to claim 1, wherein the second direction is the same as the longitudinal direction.

12. An apparatus according to claim 1, wherein, when said connector is mounted to said first supporting plate and said second supporting plate in a state that said connector is in the first position relative to said heater, a shortest distance between said holding portion and said blocking portion is shorter than the predetermined distance.

13. An apparatus according to claim 1, wherein said heater is provided with a spacer supplementing a thickness of the substrate with respect to a direction perpendicular to the substrate, said metal terminal constitutes the electrical connection point for electrical power supply to said heat generating element, by sandwiching the spacer and the substrate.

14. An image heating apparatus comprising:

a first rotatable member;

a second rotatable member cooperative with said first rotatable member to form a nip configured to heat a toner image on a recording material;

a first supporting plate provided with a first groove portion rotatably supporting said second rotatable member at a first end portion side with respect to a longitudinal direction of said second rotatable member;

a second supporting plate provided with a second groove portion rotatably supporting said second rotatable member at a second end portion side with respect to the longitudinal direction, the second end portion side being opposite to the first end side portion;

a heater unit including said second rotatable member, a heater configured to heat said second rotatable member, a connector mounted to said heater by movement relative to said heater in a first direction, a stopper portion configured to stop the relative movement of said connector relative to said heater in the first direction, said heater unit being mounted on said first supporting plate and said second supporting plate in a state that said heater unit is mounted to said heater, wherein said heater includes a heat generating element capable of generating heat by electrical power supply thereto, a first electrode portion provided on a substrate at the first end portion side and configured to supply the electrical power to said heat generating element, a second electrode portion of a polarity different from that of said first electrode portion, and a spacer supplementing a thickness of the substrate with respect to a direction perpendicular to the substrate, said connector includes a metal terminal cooperative with said first electrode portion to constitute an electrical connection point for the electrical power supply to said heat generating element, by sandwiching the spacer and the substrate, said stopper portion is configured to stop the relative movement a connector in the first direction at a first position, at which said electrical connection point is constituted by said metal terminal and said first electrode portion, said first electrode portion extends over a predetermined distance from said electrical connection point constituted by said metal terminal and said first electrode portion at the time when said connector is in the first position, in a second direction that is opposed to the first direction, and said metal terminal becomes out of electrical connection with said first electrode portion in a state that said metal terminal sandwiches the spacer at the second position, when said connector is moved from the first position in the second direction relative to said heater in a state of said metal terminal sandwiching the spacer; and a blocking portion fixed on said first supporting plate, wherein said blocking portion permits said heater unit to be mounted to said first supporting plate and said second supporting plate in a state that said connector is in the first position relative to said heater, and said blocking portion prevents said heater unit from being mounted to said first supporting plate and said second supporting plate in a state that said connector is in the second position relative to said heater.

15. An apparatus according to claim 14, wherein, when said connector is in the first position or in a position between the first position and said second position, relative to said heater, said metal terminal cooperates with said first electrode portion to constitute said electrical connection point, and said blocking portion permits said heater unit to be mounted to said first supporting plate and to said second supporting plate.

16. An apparatus according to claim 14, wherein said heater unit includes a regulating portion configured to regulate the relative movement of said connector in the second direction, when said connector is in the first position relative to said heater, wherein the relative movement from the first position to the second position when said connector is free of regulation of said regulating portion.

17. An apparatus according to claim 14, wherein said blocking portion is made of a resin material and is integrally molded with a guide portion configured to guide a position of a cable extending from said connector.

18. An apparatus according to claim 14, wherein said heat generating element, said first electrode portion, and said second electrode portion are provided on the substrate.

* * * * *